United States Patent [19]

Marzoli

[11] 4,256,202

[45] Mar. 17, 1981

[54] LUBRICATING DEVICE FOR ROTARY RINGS OF SPINNING AND TWISTING FRAMES

[75] Inventor: Angelo Marzoli, Palazzolo Sull'Oglio, Italy

[73] Assignee: F.lli Marzoli & C. S.p.A., Italy

[21] Appl. No.: 12,767

[22] Filed: Feb. 16, 1979

[30] Foreign Application Priority Data

Feb. 22, 1978 [IT] Italy ..... 20513 A/78

[51] Int. Cl.[3] ..... D01H 7/62

[52] U.S. Cl. ..... 184/7 A; 184/103 A; 57/120; 57/124

[58] Field of Search ..... 57/120, 124; 184/6.15, 184/7 A, 81, 103 R, 103 A

[56] References Cited

U.S. PATENT DOCUMENTS

| | | | |
|---|---|---|---|
| 906,155 | 12/1908 | Pearson | 184/7 A |
| 2,495,300 | 1/1950 | Thomason | 184/7 A |
| 2,867,076 | 1/1959 | Atwood | 184/7 A X |
| 3,018,605 | 1/1962 | Sherrill et al. | 184/7 A X |
| 3,664,112 | 5/1972 | Netti et al. | 57/124 X |
| 3,669,219 | 6/1972 | Wayson et al. | 184/7 A |
| 4,098,067 | 7/1978 | McLean | 57/120 |

FOREIGN PATENT DOCUMENTS

| | | | |
|---|---|---|---|
| 698903 | 12/1964 | Canada | 184/7 A |
| 2237742 | 2/1974 | Fed. Rep. of Germany | 184/7 A |
| 16778 | of 1906 | United Kingdom | 184/7 A |
| 1000365 | 8/1965 | United Kingdom | 57/124 |

*Primary Examiner*—David H. Brown
*Attorney, Agent, or Firm*—Karl W. Flocks

[57] ABSTRACT

For improving the lubrication of the rotary rings in spinning and twisting frames, a device is provided which is composed by an annular oil reservoir formed in the ring carrier immediately below the stator body, the bottom edge of the rotor body projecting into the oil reservoir and being at a distance from the inner wall of the reservoir so as to form an air passage through which atmospherical air can be drawn into the reservoir when the ring is rapidly rotated: an atomization of the oil is thus originated and the airborne oil particles may reach all the points to be lubricated.

10 Claims, 5 Drawing Figures

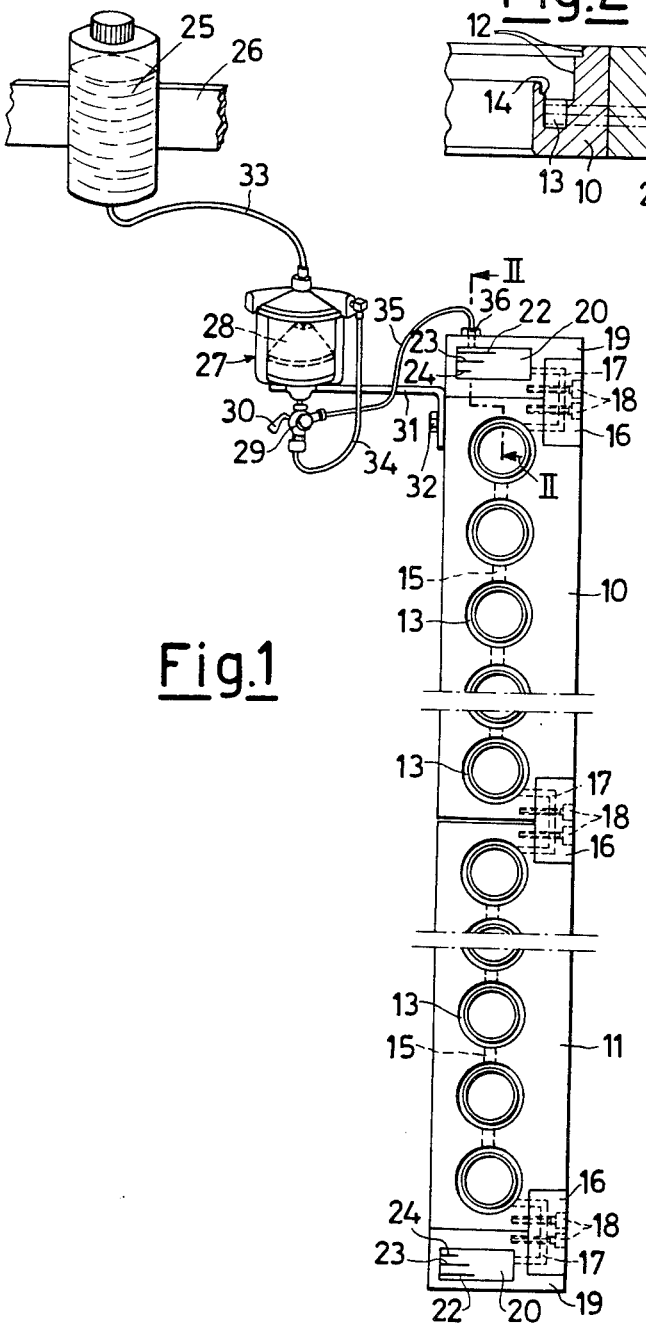
Fig.1
Fig.2
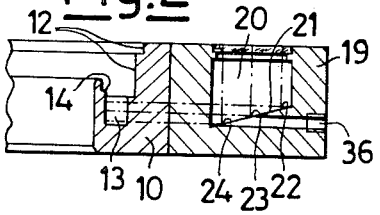

LUBRICATING DEVICE FOR ROTARY RINGS OF SPINNING AND TWISTING FRAMES

This invention relates to the rotary rings of spinning and twisting frames, that is rings comprising an annular stator body fastened to the ring-carrier of the machine and an annular rotor body which rotatably connected to the stator body by means of rolling members coaxial with the stator body and the relative machine spindle. The rotor body is driven to rotation either by the yarn itself which is being wound on the rotary bobbin, or by a mechanical connection, for example a belt system, driven by one or more motors.

It is known that the rotary spinning rings permit to obtain, as compared with the conventional fixed rings with traveler, considerable increases in the spindle rotation speed and thus in the output.

The results are considerable rotational speeds of the rotor body and thus also of the rolling members. Consequently, these rolling members, their relevant tracks on the rotor body and the stator body and the spreader members for such component parts are subjected to wear and to reduce it, it becomes necessary to provide to their lubrication.

A conventional lubrication device for spinning rings comprises a wick arranged above the rolling members and immersed in a cup which contains a felt pad impregnated with a lubricating oil. The cup is mounted on the same horizontal plane as the rotary rings and the wick sends, by capillarity, a few drops of oil onto the rolling members.

This lubrication system is unsatisfactory inasmuch as it does not ensure a constant lubrication with a uniform metering for the rings installed on the machine, with the attendant jam hazard, and requires, moreover, a daily oil topping up over the felt in the cup.

An object of the present invention is thus to remove these defects and to provide a lubricating device capable of ensuring a constant lubrication of the rotary rings mounted on the machine so as to have, at every instant of time, an oil film on the rolling members in order to prevent any jam hazard.

In order that this object may be achieved, the invention suggests a lubricating device which comprises an oil reservoir in the shape of an annular cup formed in the ring-carrier beneath the seat in which the stator body of the rotary ring is mounted, into which cup there protrudes the rotor body of the ring with its bottom edge which is spaced apart from the inner wall of the cup so as to provide between said inner wall and the bottom edge of the rotor body an air-draw passageway, means being also provided to feed said reservoir with lubricating oil.

Advantageously, these means for feeding lubricating oil to said reservoir may comprise a level-gauge adapted to maintain a constant oil level in the reservoir.

If a plurality of rotary rings are mounted on a spinning frame, the reservoirs relative to the individual rings are connected to each other by ducts that can be directly formed in the frame and connection conduits may also be provided between adjoining spinning frames.

If the machine is fitted with individual ring-carriers for each individual ring, the bar on which such individual ring-carriers are mounted can be hollowed out and act as a connection conduit, from which individual connection passageways may branch-off and go to the oil reservoirs formed for the individual ring-carriers.

Further features and advantages of the lubricating device according to the present invention will become apparent from the ensuing description of a few embodiments of illustrative nature which are diagrammatically shown in the accompanying drawings, wherein:

FIG. 1 is a plan view of the lubricating device according to the invention.

FIG. 2 is a close-up view shown in cross-section taken along the line II—II of FIG. 1.

Figure 3:
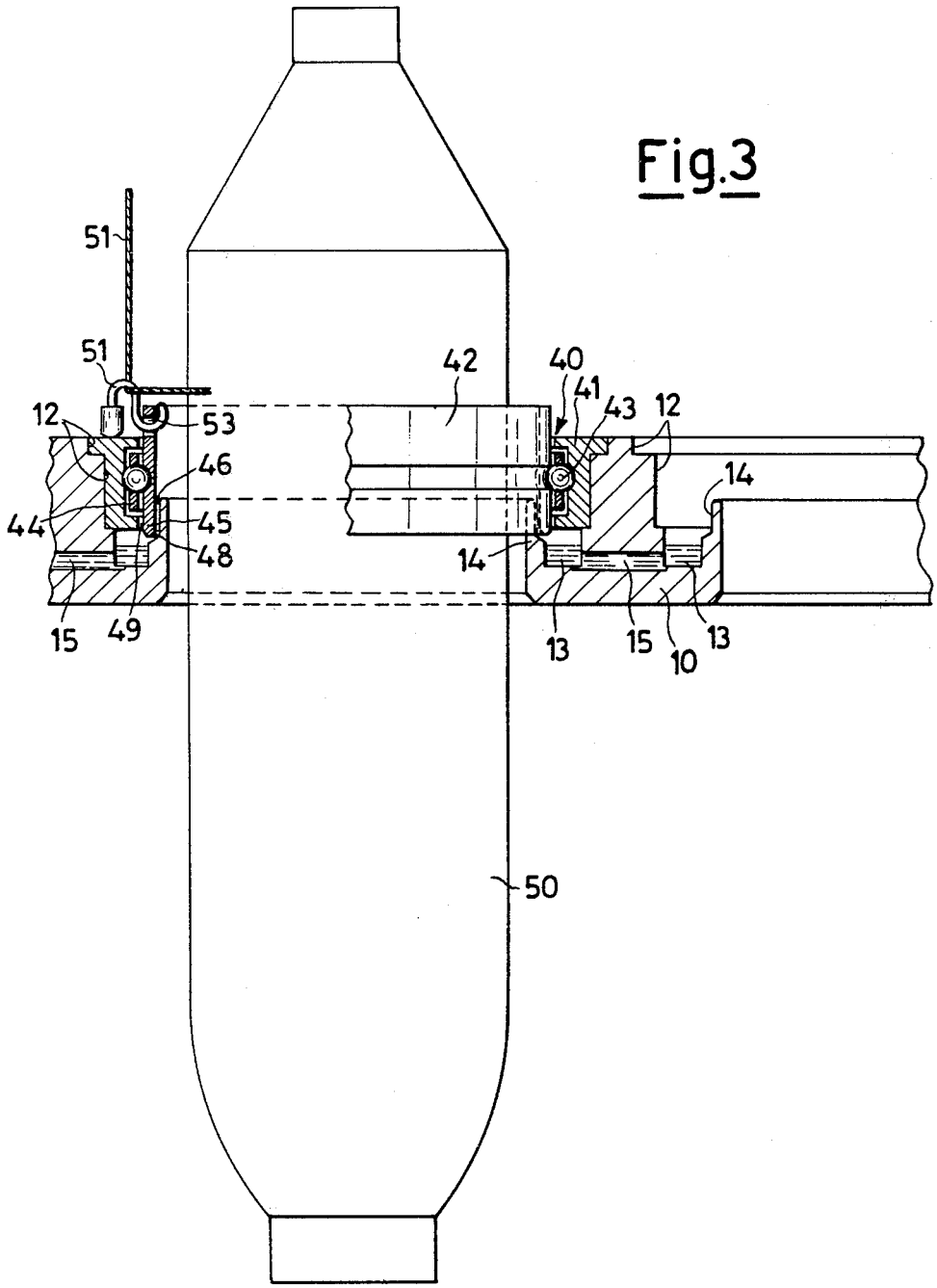
FIG. 3 shows on an enlarged scale and partly in vertical cross-sectional view a rotary ring mounted on the frame shown in FIG. 1.

Having now reference, at the outset, to FIGS. 1 to 3, FIG. 1 shows in plan view and in quite diagrammatical a way, two adjoining frames, 10 and 11, respectively, of a spinning or twisting machine. It should be noted that in this FIGURE there have been omitted both the rotary rings and the respective spindles in order not to overcrowd the drawings (the same is true of FIG. 2 and the right-hand portion of FIG. 3).

In each of such ring-carrying frames there are formed circular seats 12 for mounting as many rotary rings, as will be described in more detail with reference to FIG. 3.

Beneath each seat 12 is formed, in the frame, a reservoir 13 for the lubricating oil, in the shape of an annular cup confined towards the interior by a circular peripheral wall 14.

The reservoirs 13 in each frame 10 or 11 are connected to each other via conduits 15 which are also formed in the frame.

The flow of the oil between the two ring-carrying frames 10 and 11 is ensured by a small block 16, made for example of a transparent material, and in which a conduit 17 is provided to establish a communication between the last reservoir of a frame and the first reservoir of the next adjoining frame. The block 16 is mounted in appropriate spaces of the frames 10 and 11 and is secured by means of screws 18.

To the free ends of the frames 10 and 11, bodies such as 19 are secured, in which there are formed cups 20 having the function of level gauges. As can be seen in FIG. 2, the cup 20 has a floor 21 at an incline and on which three reference lines 22, 23 and 24 are marked for the indication of the maximum, medium and minimum levels of the oil, respectively. This expedient permits that the oil level may be read out in the horizontal rather than in the vertical direction (see FIG. 1).

The cups 20 are in communication with the next adjoining reservoirs 13 in the respective frames, via ducts, such as 17, formed in blocks such as 16.

At least one of the cups 20 is connected to an automatic oil-feeding device. In FIG. 1, the lubricating oil is fed only to the cup formed in the body 19 fastened to the frame 10, but, if the frame is very long, oil feed could be provided also in the opposite cup formed in the body 19 fastened to the frame 11.

The means for feeding the lubricating oil are shown in FIG. 1 in a quite diagrammatical way and not in their actual positioning in the machine. They comprise an oil container 25 fastened to a portion of the machine casing 26, a level-adjuster 27 equipped with a floater 28 and a three-way valve 29 with a cock 30. The level-adjuster 27 and the valve 29 are mounted on the frame 10 by means of bracket 31 screwably affixed by screws 32 so that they follow the movement of the frame.

A hose 33 connects the bottom wall of the container 25 to the top inlet of the level-adjuster 27. The valve 29 with the cock 30 is directly connected to the outlet of the level-adjuster and two hoses 34, 35 branch off from such valve, the former hose being directly connected with the hose 33 which draws oil from the container 25 (thus by-passing the level-adjuster 27), whereas the latter hose 35 connects the valve 29 to a fitting 36 provided on the body 19 and communicating with the cup 20 in said body 19. For the initial filling of all the reservoirs 13 with lubricating oil, the cock 30 is so positioned that the valve 29 establishes a communication between the hoses 34 and 35, the level-adjuster 27 being thus by-passed. Oil is thus allowed to flow from the container 25, via the hoses 33, 34 and 35 into the cup 20 and, therefrom, into all of the reservoirs 13 connected therewith. As the oil attains the reference line 22, the cock 30 is so positioned that the outlet of the level-adjuster 27 is in communication, via the valve 29, with the hose 35. The floater 28 of the level-adjuster 27 cuts off the oil flow from the container 25. As oil becomes used up in the entire system, the level is automatically topped up since, as the floater 28 drops, oil feed to the level-adjuster 27 takes place and the oil, via the valve 29 and the hose 35, reaches the cup 20 and from the latter it feeds the several reservoirs 13. Whenever it is desired to make upkeep operations, the cock 30 is so positioned as to close the communication towards the hose 35 via the valve 29.

Having now reference to FIG. 3, the lubrication system for one of the rotary rings will be described in detail.

The rotary ring is generally indicated at 40 and is mounted in one of the seats 12 formed in the frame 10. The rotary ring 40 comprises an annular stator body 41 secured in the seat 12. The bottom edge of the body 41 partially covers the annular reservoir 13 formed in the frame 10 below the seat 12. Concentrically with the stator body 41 there is mounted an annular rotor body 42 which is coupled for rotation relative to the stator body 41 by means of rolling members 43 which are held circumferentially spaced apart from each other by a cage 44. The bottom edge 45 of the rotor body 42 partially projects from the reservoir 13 and is slightly spaced apart from the internal wall 14 of the reservoir 13 (to this purpose, the wall 14 can be tapered as best seen in FIG. 3). Between the bottom edge 45 of the rotor body 42 and the internal wall 14 of the reservoir 14 a passageway 46 is thus provided for air so that atmospherical air is drawn therethrough whenever the rotor body 42 is rotated at a high rotational speed, the direction of suction being towards the reservoir 13. In order that the suction effect provided by the rotor body 42 (which behaves like the rotor of a centrifugal pump) may be improved, the bottom edge 45 of the rotor body 42 can have beveled zones 48.

The air which thus drawn through the passageway 46 is directed towards the lubricating oil contained in the reservoir 13 and causes an atomization of the oil and the oily mist, through the free passageway 49 between the rotor body 42 and the stator body 41, goes to lubricate the rolling members 43 and the tracks on the stator body and the rotor body over which said rolling members travel, as well as the cage 44.

Thus a constant lubrication is provided, in operation, for all the rotary rings mounted on the frame and, at every instant of time, there is an oil film on the moving surfaces so that any jam hazard is offset.

It should be noted that the rotor body 42 of the rotary ring 40 can be driven to rotation in a number of ways.

In the example shown in FIG. 3, the rotor body 42 is driven to rotation by the yarn 51 which is wound on the rotary spool 50 fastened to the spindle (not shown), the latter being coaxial with the rotary ring 40. The yarn 51 passes through a member 52 which is hooked in a bore 53 of the rotary body 42 and acts also as a brake in a manner known per se.

There is nothing, however, against commanding the rotation of the rotor body 42 by means of an appropriate mechanism.

Figure 5:
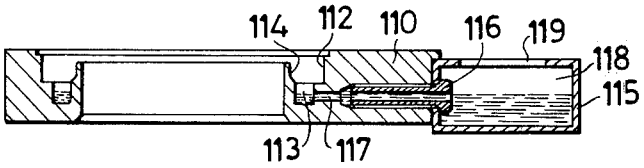
FIG. 5 shows a detail in cross-sectional view taken along the line V—V of FIG. 4.
Figure 4:
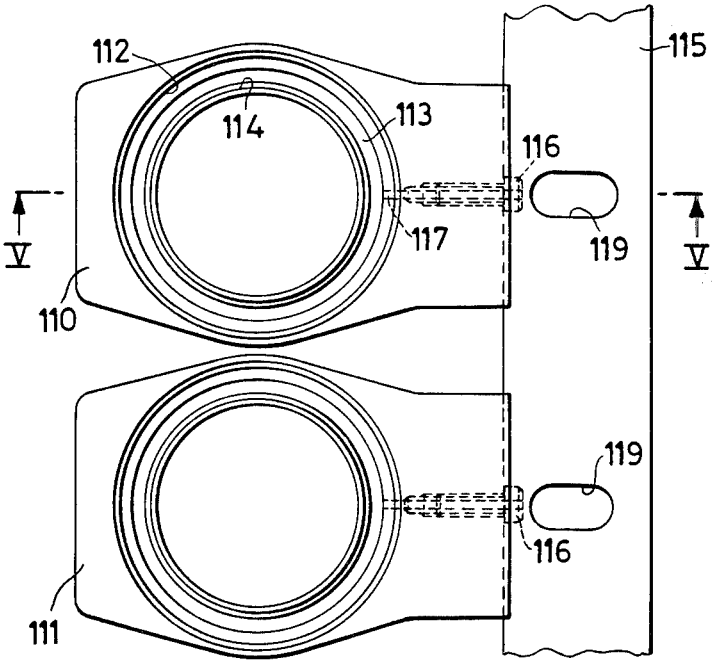
FIG. 4 is a plan view which shows how the lubricating device is mounted in the case of a machine having individual ring-carriers.

Having now reference to FIGS. 4 and 5, there has been shown the practical case in which the lubrication device according to the invention has been applied to a machine in which every rotary ring has been mounted in a ring-carrier of its own.

FIG. 4 shows two discrete ring-carriers, indicated at 110 and 111, each of which has, formed thereon, a seat 112 with an attendant underlying annular reservoir 113 for the lubricating oil, the reservoir being confined towards the interior by a circular wall 114.

The mounting of the rotary ring (not shown) in each seating 112 is effected in very much the same way as described with reference to FIG. 3.

The individual ring-carriers 110, 111, etc. are fastened to a hollow bar 115 having a rectangular cross-sectional outline, and more detailedly by means of a screw 116 which is screwed into a bore 117 of the respective ring-carrier, the bore being extended to the respective reservoir 113. Since the screw 116 is bored, it establishes a communication between the space 118 of the bar 115 and the reservoir 113. The hollow bar 115 thus becomes a connection conduit between the reservoirs 113 provided in the individual ring-carriers 110, 111, etc. The lubricating oil is fed, in the same way as outlined above with reference to FIGS. 1 and 2, to the space 118 of the bar 115, so that a constant oil level is established in all of the reservoirs 113.

Windows 119, formed through the top wall of the bar 115, and which can be closed by special plugs (not shown) permit that the screws 116 are tightened with appropriate tools.

Also in this case of practical use, the operation of the lubrication device is identical with the one described above.

The lubrication device according to the invention can be applied, of course, also in the case in which there is a single rotary ring present: in such a case, as it is obvious, there are no communication conduits between a number of oil reservoirs associated to a number of rotary rings.

I claim:

1. A lubricating device for rotary rings of spinning and twisting frames, wherein the rotary ring comprises an annular stator body secured in a seat formed in a ring-carrier and an annular rotor body coaxial with and coupled for rotation relative to the stator body by rolling members kept spaced apart from each other circumferentially by a cage, characterized by an oil reservoir having the form of an annular cup formed in the ring-carrier beneath the seat in which the stator body of the rotary ring is secured, in said reservoir the rotor body projects with its lower edge which is spaced apart from the internal wall of the reservoir so as to provide between said internal wall and the lower edge of the rotor by an air-drawing passageway, means being also provided for feeding lubricating oil to said reservoir.

2. Device according to claim 1, characterized in that for improving the air-draw through said passageway towards the reservoir, the lower edge of the rotor body has beveled surfaces.

3. Device according to claim 1, for a machine in which a plurality of rotary rings are provided, each ring being mounted in a discrete ring-carrier, said ring-carriers being secured to a bar, characterized in that said bar is hollow and acts also as a connection conduit from which individual connection ducts branch off for the reservoirs formed in the individual ring-carriers.

4. Device according to claim 3, characterized in that each individual ring-carrier is fastened to said hollow bar by a bored screw screwed into a passageway which terminates in the oil reservoir formed in the respective ring-carrier.

5. Device according to claim 1, characterized in that the means for feeding the lubricating oil comprise an oil container connected to a level-adjuster which is connected in its turn to the oil reservoir associated with the seat of the rotary ring, said level-adjuster being provided with a floating means to cut off the oil feed when the level of the oil in the reservoir has attained a preselected value, and to restore the oil feed when the level of the oil drops below said preselected level value.

6. Device according to claim 5, characterized in that the feeding means further comprise between the level-adjuster and the reservoir a three-way valve and a cock for connecting the oil container selectively to said reservoir directly and to cut off the oil feed.

7. Device according to claim 5, characterized in that the reservoir is provided with a level gauge.

8. Device according to claim 1, for a machine in which a plurality of rotary rings is mounted in at least a ring-carrying framing, characterized in that the oil reservoirs associated with the seats of the individual rings as formed in said framing are connected to each other by conduits which are likewise formed in the framing.

9. Device according to claim 8, for a machine having at least two ring-carrying framings adjacent to one another, characterized in that the reservoir associated to the last seating of a framing is in communication with the reservoir associated to the first seating of the adjoining framing through a connection conduit.

10. Device according to claim 9, characterized in that said connection conduit is formed in a block which is inserted into and fastened to corresponding hollow spaces provided in the two adjoining framings.

* * * * *